United States Patent [19]

Bright et al.

[11] 4,190,310

[45] Feb. 26, 1980

[54] EJECTION DEVICE FOR A ELECTRONIC PACKAGE CONNECTOR

[75] Inventors: Edward J. Bright, Elizabethtown; Gabriel B. Cherian, York; William S. Scheingold, Palmyra, all of Pa.

[73] Assignee: AMP Incorporated, Harrisburg, Pa.

[21] Appl. No.: 892,522

[22] Filed: Apr. 3, 1978

[51] Int. Cl.[2] ..... H01R 13/62

[52] U.S. Cl. ..... 339/45 R; 339/45 M; 339/46

[58] Field of Search ..... 339/45 R, 45 M, 45 T, 339/46, 75 M; 221/208; 222/225; 425/436 RM, 440; 429/100, 96

[56] References Cited

U.S. PATENT DOCUMENTS

| | | | |
|---|---|---|---|
| 1,172,694 | 2/1916 | Flint | 339/45 M |
| 2,155,778 | 4/1939 | Stratton | 339/45 T X |
| 2,205,316 | 6/1940 | Stratton | 339/45 T X |
| 2,919,317 | 12/1959 | Mercer et al. | 339/45 R X |
| 3,035,243 | 5/1962 | Bowling | 339/45 M |
| 4,077,689 | 3/1978 | Feldberg | 339/75 M |

FOREIGN PATENT DOCUMENTS

| | | | |
|---|---|---|---|
| 99574 | 4/1925 | Austria | 339/45 M |
| 1209568 | 10/1970 | United Kingdom | 339/45 M |

*Primary Examiner*—William R. Briggs
*Attorney, Agent, or Firm*—Allan B. Osborne

[57] ABSTRACT

The present invention relates to a device for ejecting an electronic package from a connector. More particularly, the device includes a flat spring member adapted to be arched upwardly to push a electronic package out of engagement from the connector.

22 Claims, 5 Drawing Figures

EJECTION DEVICE FOR A ELECTRONIC PACKAGE CONNECTOR

BACKGROUND OF THE INVENTION

1. Field of the Invention

The present invention is related to ejecting devices from connectors of the type which retain and electrically connect an electronic package to a printed circuit board.

2. Prior Art

Generally conventional connectors do not have means associated therewith that directly eject the package. Spaces on either side of the connector are provided so that a thumb or tool can be inserted beneath the package so as to exert an upward force. One British Pat. No. 1,209,568 does disclose a slide member with cooperating ramp surfaces on the connector so that the member can be slid under the package. The slide member being wedge-shaped pushes the package out of the connector.

SUMMARY OF THE INVENTION

The present invention is a spring which is positioned on a connector between the connector and package. To eject the package, the spring is first arched upwardly and then buckled. The package becomes completely free of the connector.

DESCRIPTION OF THE INVENTION

Figure 1:
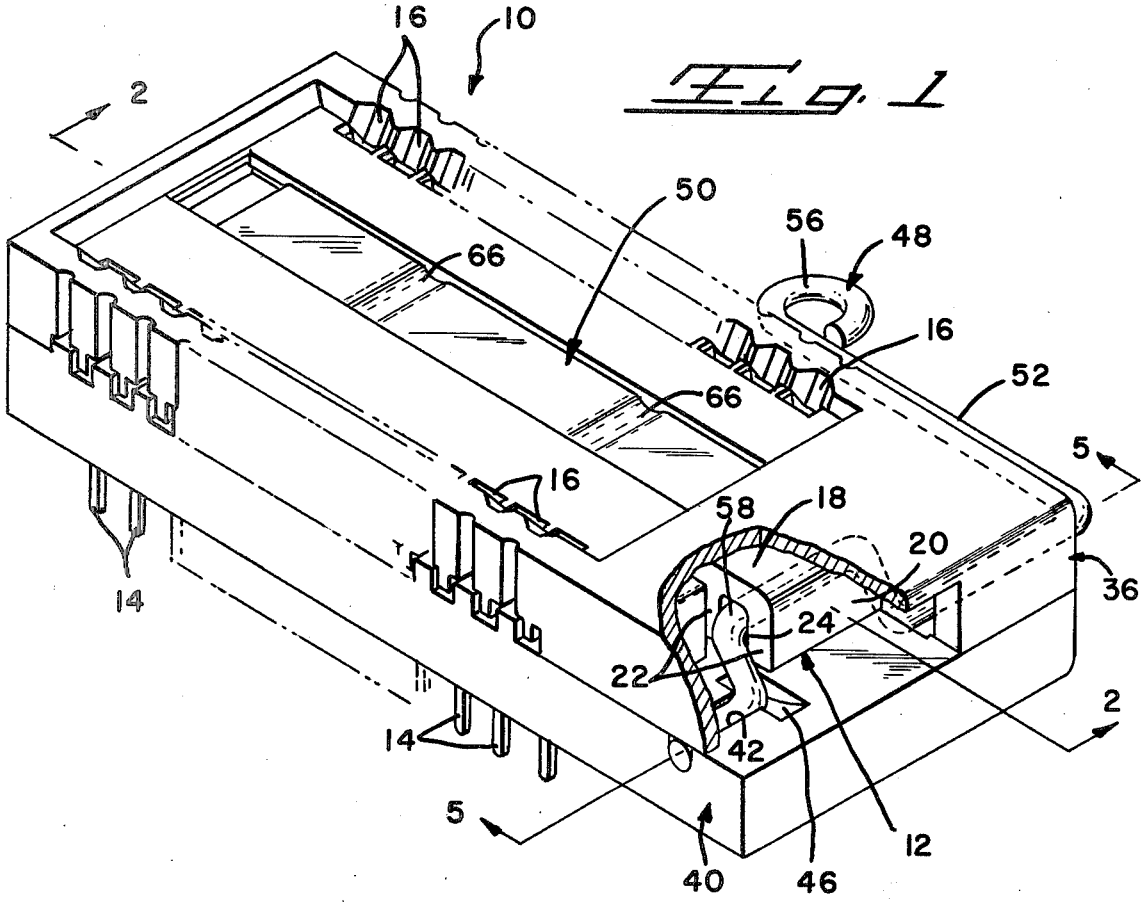
FIG. 1 is a perspective view of a electronic package connector incorporating the ejecting device of the present invention.
Figure 5:
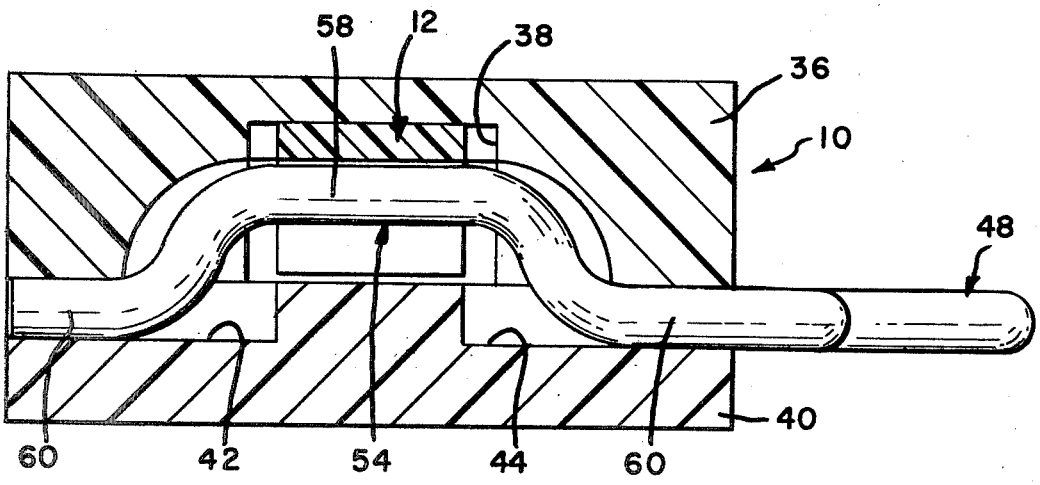
FIG. 5 is a end cross-sectional view taken along lines 5—5 of FIG. 1.

The ejection device of the present invention may be utilized in many different connectors. It may be used just as an ejection device. However, it also may be used as an integral part of the connector. It is in this latter context that the following description applies. However, no unnecessary limitations are to be derived from the manner in which the present invention is explained.

Incorporated herein by reference is U.S. Pat. No. 4,080,032 which discloses a connector of the type generally indicated by reference numeral 10 in FIGS. 1–5 except for the ejection device generally indicated by reference numeral 12. Connector 10 has a plurality of contacts on either side each with depending pins 14 and two arms (not shown) between which the legs of a electronic package (not shown) are inserted. As is well known, the package is loaded onto the top of the connector with its legs entering inbetween the contact arms via openings 16. In the connector of the referenced patent, draw bar 18 is moved longitudinally by means of a device such as a screw driver (not shown). Through a ramp and slot configuration, actuating members (not shown) which are connected to one of the two arms are moved transversely to pull the arms apart for insertion or removal of the package legs. With device 12 of the present invention positioned in connector 10, use of a screw driver is not needed and, when it is desired to remove an electronic package from the connector, the device dislodges it therefrom. The electronic package is then free of all restraints and can be removed with no effort. If the connector is held upside down, the package will fall freely from the connector. This is an important aspect of the ejector mechanism because it allows simultaneous removal of packages from an array of connectors. This characteristic is of advantage in test and burn-in applications where large numbers of packages must be quickly inserted and removed from connectors.

Figure 2:
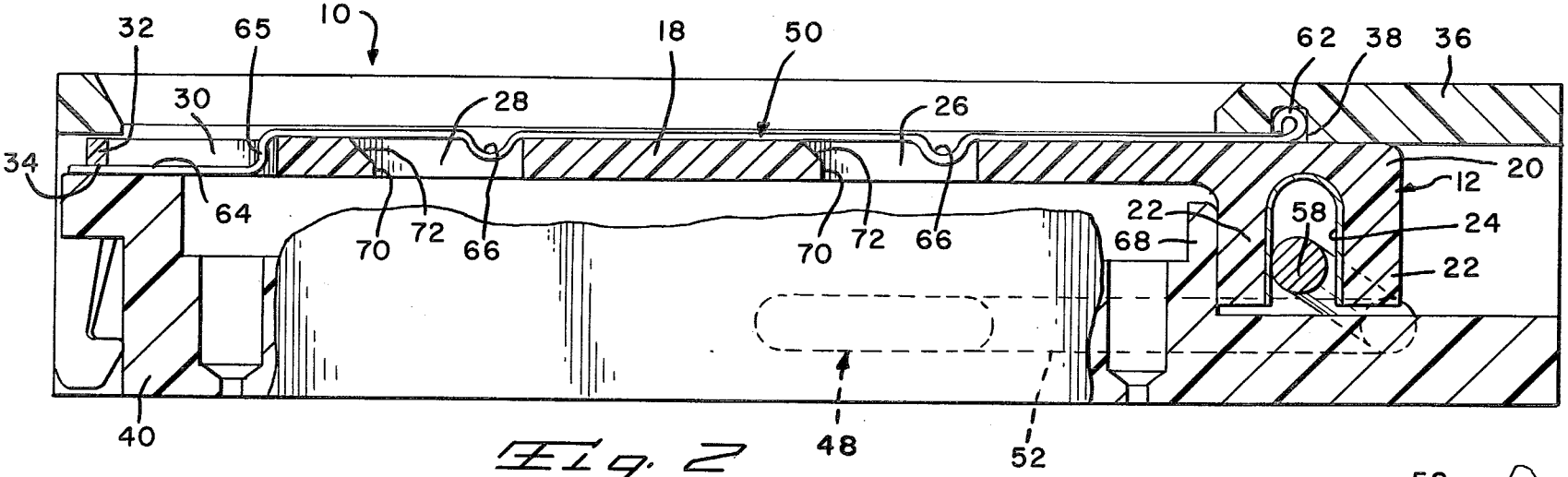
FIG. 2 is a side cross-sectional view taken along lines 2—2 of FIG. 1.
Figure 3:
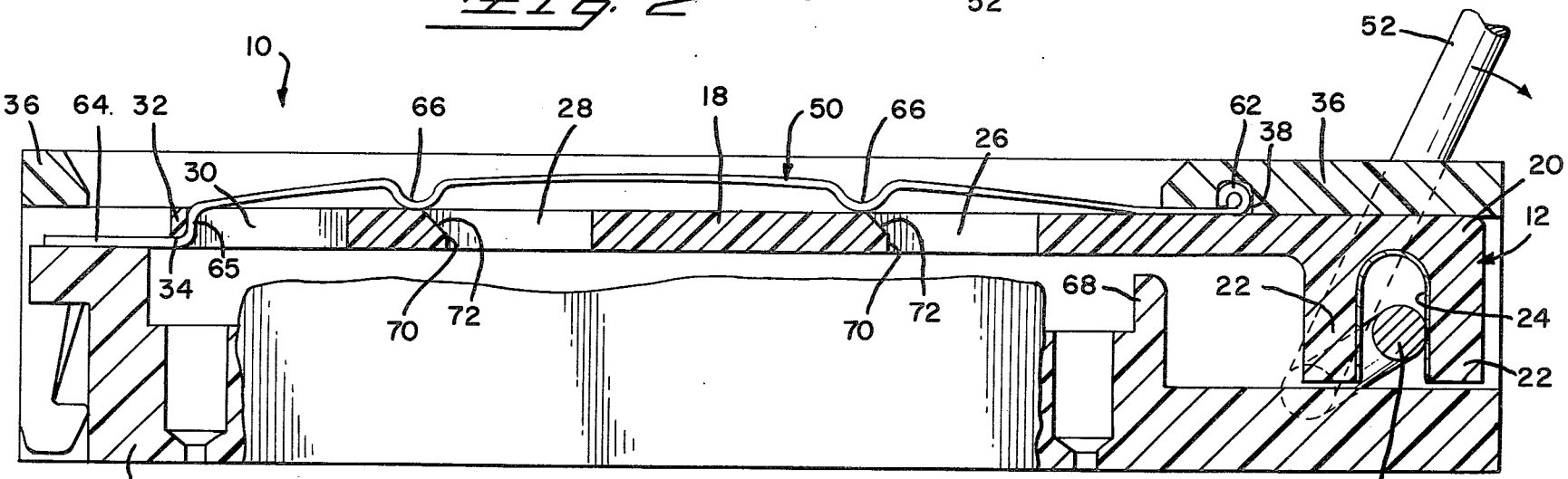
FIG. 3 is the cross-sectional view of FIG. 2 illustrating the device of the present invention in its initial ejecting mode.
Figure 4:
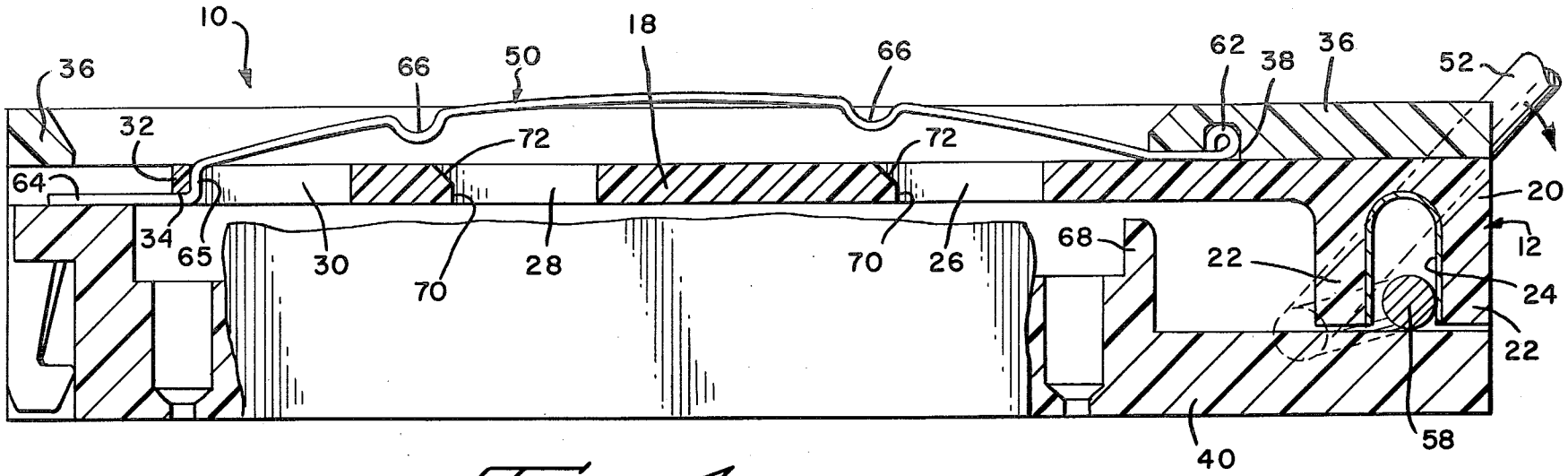
FIG. 4 is the cross-sectional view of FIG. 2 illustrating the device of the present invention in its final ejecting mode.

Draw bar 18, which is channel-shaped in cross-section (the two sides facing downward) is modified from its shape in the referenced patent. As can be seen in FIGS. 2–4, one end 20 has a pair of spaced, depending transverse walls 22 to define a transverse slot 24. The surface of the bar has first, second and third openings, designated by reference numerals 26, 28 and 30 respectively. The left end wall 32 of the bar has a passage 34 cut through it.

Cover 36 of the connector has been modified by cutting recess 38 into its undersurface adjacent the right end.

Base 40 has been changed also. As can be seen in FIGS. 1 and 4, two grooves 42 and 44 have been added. These grooves enter into the base on each side near the right end of the base and open onto the upper surface thereof. Inwardly the grooves terminate in longitudinally extending slots 46.

Device 12 of the present invention as herein described includes a handle 48 and elongated resilient member, referred to hereinafter as an eject spring 50.

Handle 48, which may be made from round rigid wire, is L-shaped with a lever 52 and cam section 54. The lever section lies outside the connector and may terminate in an eye 56 for ease in operator holding and moving. Looking at FIG. 5, the cam section is the part of the handle laying within the connector and is characterized by being U-shaped in the middle with straight portions at either side. The U-shaped portion, designated by reference numeral 58, is received in slot 24 on the draw bar's right end 20. The straight portions, designated by reference numeral 60 are received in grooves 42 and 44.

Eject spring 50 may be stamped and formed from spring materials such as beryllium copper, high carbon steel and also stainless steel. At one end the material is rolled back on itself to form a hook-like end 62. The opposite end 64 is displaced downwardly by a jog 65. Two spaced apart dimples 66 are formed across the width of the spring and are positioned along the length thereof.

Eject spring 50 is located above the draw bar 18 with the hook-like end 62 immovably secured in recess 38 in the connector cover 36. End 64 is received in passage 34 in draw bar 18. The dimples project into openings 26 and 28.

FIGS. 1 and 2 show the connector 10 and the attached insertion and ejection device 12 in a closed/on position; that is, with lever 52 lying alongside the connector, cam section 54 had moved draw bar 18 to the left. This may be seen better in FIG. 2. Note that an internal wall 68 stops further leftward movement of the bar. Spring 50 is lying flat on the draw bar with the dimples in openings 26 and 28. Not shown are the contact arms which would be squeezing in on legs of a electronic package should one be present.

FIG. 3 illustrates the initial step in ejecting a package from the connector. As lever 52 of handle 48 is rotated towards the right, cam section 54 cams draw bar 18 to the right. The left hand walls 70 of openings 26 and 28 engage dimples 66. The walls, being preferably beveled as indicated by reference numberal 72, cam the spring upwardly into the arched position shown in FIG. 3. The arching of course must reduce the spring's longitudinal or flat length. To accommodate the shortening, the spring's non-attached or free end 64 moves inwardly. It cannot move vertically upwardly because of its being confined in passage 34 extending through end wall 32 of the draw bar. As noted above, end 62 of the spring is immovably secured in recess 38 in cover 36 which is stationary (relative to draw bar 18).

With the draw bar moving towards the right, the contact arms are being pulled laterally away from engagement with the legs of the electronic package. This occurs during the initial movement of the draw bar and before the camming surface 72 acts on dimples 66. When the cam surfaces 72 come into contact with dimples 66, the arms of the contacts are in the fully opened position.

As the spring arches upwardly, an electronic package which may be in the connector is being pushed upwardly.

With further right movement of handle 48, the end wall 32 abuts the jog 65 (FIGS. 3 and 4) in the spring and the final ejection phase begins. The spring, being further shortened, buckles upwardly as shown in FIG. 4. The buckling pushes the package completely free of the connector.

As will be recognized by those skilled in the art, the force required to buckle spring 50 has been greatly reduced by the initial step of camming the spring upwardly as shown in FIG. 3. Once the spring is predisposed in that arched condition, the further step of buckling requires little force.

As used herein, the term buckling implies resilient deformation; i.e., one from which the spring fully recovers.

As noted above, the ejection device 12 may be used in connectors other than the type shown and discussed above.

Also, the device may be used in connectors of the type accepting leadless packages. One type of such a connector is disclosed in U.S. Pat. No. 4,052,118. Another type connector which may use the present invention is disclosed in U.S. Pat. No. 3,877,064.

It should be readily apparent that draw bar 18 need not be associated with the opening or closing of the contacts in the connector. Futher, means of anchoring spring 50 can be used other than that shown. Accordingly, the detailed description given above is for clearness of understanding only and no unnecessary limitation should be understood therefrom.

We claim:

1. An ejector device for use on a connector into which an electronic package may be removably inserted, the device comprising:

a. an elongated spring positioned on the connector with one end fixed thereto, and with the mid-portion positioned so as to be under an electronic package which may be removably inserted into the connector; and b. means for moving the other end towards the fixed end thereby arching the mid-portion of the spring upwardly whereby the electronic package would be pushed away from the connector.

2. An ejector device for use on a connector into which an electronic package may be removably inserted, the device comprising:

a. an elongated spring positioned on the connector with a first end fixed to the connector and the second end free to be moved, longitudinally, further the mid-portion of the spring being positioned so as to be under an electronic package which may be removably inserted into the connector; and b. means for moving the second end towards the first end thereby arching the mid-portion of the spring upwardly whereby the electronic package would be lifted away from the connector.

3. The ejector device of claim 2 wherein the means for moving the second end towards the first end includes a sliding member positioned beneath the spring.

4. The ejector device of claim 3 wherein the spring includes a depending dimple and the sliding member has an opening adapted to receive the dimple so that as the sliding member is moved one of the walls defining the opening engages and cams the dimple thereby arching the spring upwardly.

5. The ejector device of claim 3 wherein the sliding member includes means thereon to engage the second end of the spring so that as the sliding member is moved, the means thereon draws the second end of the spring inwardly causing the mid-portion to raise upwardly.

6. The ejector device of claim 4 wherein the sliding member includes means thereon to engage the second end of the spring so that after the spring has been cammed upwardly, further movement of the sliding member pulls the second end of the spring longitudinally inwardly so as to cause the spring to arch further upwardly.

7. The ejector device of claim 4 or 6 wherein the wall defining the opening which engages the dimple is beveled on its dimple-engaging edge.

8. An ejector device for use on a connector having two parallel rows of spaced-apart contact sockets into which the legs of an electronic package may be removably inserted, the device comprising:

a. an elongated, resilient member, being generally planar, positioned on the connector between the two rows of contact sockets, a first end of the member being fixed to the connector and at least part of the mid-portion of the member positioned so as to underlie an electronic package which may be inserted into the connector; and b. means for moving the second end of the member towards the first end and thereby causing the mid-portion to bend upwardly, pushing against an electronic package which may be inserted into the connector.

9. The ejector device of claim 8 wherein the means for moving the second end of the resilient member includes a slidable member with means thereon to engage said second end.

10. The ejector device of claim 9 wherein a portion of the slidable member underlies the mid-portion of the resilient member and said slidable member may be moved for a given distance before engaging the second end of the resilient member.

11. The ejector device of claim 10 wherein the slidable member and the mid-portion of the resilient member have cooperating means such that as the slidable member is being moved over said given distance, the cooperating means cooperate to cause said mid-portion of the resilient member to bend upwardly.

12. The ejector device of claim 11 wherein the cooperating means on the slidable member includes an opening and on the resilient member includes a dimple which extends into the opening so that as the sliding member moves over the given distance, the wall of the opening engages and cams the dimple out of the opening, thereby bending the mid-portion upwardly.

13. An ejector device for use on a connector into which an electronic package may be removably inserted, the device comprising:

a. an elongated resilient member positioned on the connector with a first end attached to the connector and with the mid-portion positioned to underlie an electronic package which may be removably inserted in the connector;

b. a sliding member positioned beneath the resilient member;

c. means to move the sliding member reciprocally; and d. cooperating means on the sliding and resilient members so that as the sliding member moves, the cooperating means causes the mid-portion of the resilient member to arch upwardly, pushing against an electronic package which may be positioned thereover.

14. The ejector device of claim 13 wherein the cooperating means includes an opening in the sliding member and a dimple in the resilient member which depends into the opening so that as the sliding member moves, the wall of the opening engages and cams the dimple out of the opening thereby arching the mid-portion upwardly.

15. The ejector device of claim 14 wherein the sliding member includes means thereon to engage the second end of the resilient member so as to move the second end towards the first end.

16. The ejector device of claim 15 wherein the sliding member may be moved for a given distance before engaging the second end of the resilient member.

17. The ejector device of claim 16 wherein the given distance is the length required to cam the dimple in the resilient member out of the opening in the sliding member.

18. An ejector device for use on a connector into which an electronic package may be removably inserted, the device comprising;

a. an elongated, resilient member positioned on the connector with a first end fixed to the connector, with at least part of the mid-portion positioned to underlie an electronic package which may be removably inserted in the connector and with the second end free to move towards the first end; and b. means for causing the resilient member to bow upwardly so that the mid-portion pushes against the electronic package in a direction away from the connector.

19. The ejector device of claim 18 wherein said means includes a slidable member underlying the resilient member and both members have cooperating means thereon so that as the slideable member is moved over a given distance, the cooperating means cooperate to bow the resilient member upwardly.

20. The ejector device of claim 19 wherein the slideable member has engaging means thereon to engage the second end and move it towards the first end.

21. The ejector device of claim 20 wherein the engaging means engage the second end after the slideable member has moved the given distance.

22. The ejector device of claim 18 wherein said means includes a slideable member underlying the resilient member with the slideable member having engaging means thereon adapted to engage the second end of the resilient member and move it towards the first end thereby bowing the resilient member upwardly.

* * * * *